US012662806B2

(12) United States Patent
Cochet et al.

(10) Patent No.: US 12,662,806 B2
(45) Date of Patent: Jun. 23, 2026

(54) PANELS DESIGNED FOR PRODUCING A WALL AND METHODS FOR PRODUCING SUCH PANELS

(71) Applicant: CARBON CAPTURE BUILDINGS GREENTECH, Beaurepaire (FR)

(72) Inventors: François Cochet, Barraux (FR); Laurent Noca, Hauterives (FR)

(73) Assignee: CARBON CAPTURE BUILDINGS GREENTECH, Beaurepaire (FR)

( * ) Notice: Subject to any disclaimer, the term of this patent is extended or adjusted under 35 U.S.C. 154(b) by 789 days.

(21) Appl. No.: 17/788,975

(22) PCT Filed: Dec. 24, 2020

(86) PCT No.: PCT/EP2020/087890
§ 371 (c)(1),
(2) Date: Jun. 24, 2022

(87) PCT Pub. No.: WO2021/130378
PCT Pub. Date: Jul. 1, 2021

(65) Prior Publication Data

US 2023/0032320 A1 Feb. 2, 2023

(30) Foreign Application Priority Data

Dec. 24, 2019 (FR) ..... 1915563

(51) Int. Cl.
*E04B 1/14* (2006.01)
*E04B 1/04* (2006.01)
*E04C 2/26* (2006.01)

(52) U.S. Cl.
CPC ..... *E04B 1/14* (2013.01); *E04B 1/04* (2013.01); *E04C 2/26* (2013.01)

(58) Field of Classification Search
CPC ..... E04B 1/04; E04B 1/14; E04C 2/26
(Continued)

(56) References Cited

U.S. PATENT DOCUMENTS 1,111,131 A * 9/1914 Broughton ..... E04B 1/14 52/270
2,061,281 A * 11/1936 Lawlor ..... E04B 2/56 52/761

(Continued)

FOREIGN PATENT DOCUMENTS

BE 779339 A * 5/1972 ..... B29C 70/025
BE 1008395 A6 5/1996

(Continued)

OTHER PUBLICATIONS

Mar. 26, 2021 International Search Report issued in International Patent Application No. PCT/EP2020/087890.

*Primary Examiner* — Brian D Mattei
*Assistant Examiner* — Joseph J. Sadlon
(74) *Attorney, Agent, or Firm* — Oliff PLC

(57) ABSTRACT

Panel designed for making a wall, including a monobloc part made from concrete inside which pieces of wood are sunk, at least one through aperture being formed inside the monobloc part, the panel including at least one reinforcement element providing a bending resistance and housed inside said at least one through aperture, said at least one reinforcement element being formed by an armature coated with a hardening product including a binder.

11 Claims, 7 Drawing Sheets

(58) Field of Classification Search
USPC ..... 52/270
See application file for complete search history.

(56) References Cited

U.S. PATENT DOCUMENTS 2,620,651 A * 12/1952 Brauer ..... E04B 1/04 52/584.1
2,851,873 A * 9/1958 Wheeler-Nicholson ..... E04B 1/165 52/576
3,145,502 A * 8/1964 Rubenstein ..... E04C 2/26 52/223.7
3,295,279 A * 1/1967 Wilkins ..... A47B 96/20 428/117
3,679,529 A * 7/1972 Prusinski et al. ..... B32B 15/08 52/309.7
3,803,788 A * 4/1974 Artmann ..... E04H 1/005 52/432
3,826,051 A * 7/1974 Miller ..... B29C 67/245 52/274
3,922,413 A * 11/1975 Reineman ..... B32B 3/26 52/576
3,953,629 A * 4/1976 Wesch ..... E04C 2/16 428/407
4,002,788 A * 1/1977 Lott ..... E04C 2/284 428/307.3
4,114,345 A * 9/1978 Nilsen ..... E04B 1/14 264/45.2
4,255,915 A * 3/1981 Muriotto ..... B28B 23/02 52/601
4,572,861 A * 2/1986 Barretto Garcia ..... B28B 1/522 428/407
4,615,166 A * 10/1986 Head ..... E04C 2/22 52/783.17
4,627,199 A * 12/1986 Capaul ..... B32B 15/14 181/290
4,669,240 A * 6/1987 Amormino ..... E04B 1/04 52/745.1
4,741,135 A * 5/1988 Baena ..... E04B 1/043 52/223.7
5,136,822 A * 8/1992 Blum ..... E04B 1/14 52/241
5,299,400 A * 4/1994 Sing ..... B27M 3/0053 144/368
5,373,673 A * 12/1994 Albritton ..... E04C 2/08 52/270
5,493,836 A * 2/1996 Lopez-Munoz ..... E04B 1/06 52/270
5,580,637 A * 12/1996 Konta ..... B32B 15/046 428/137
5,786,063 A * 7/1998 Shibusawa ..... B27M 1/08 144/333
5,797,238 A * 8/1998 Berntsson ..... B28B 1/16 52/223.6
5,803,964 A * 9/1998 Scarborough ..... E04B 1/161 106/737
5,814,253 A * 9/1998 Sikaffy ..... C04B 28/04 106/711
5,840,226 A * 11/1998 Fujii ..... C04B 28/02 264/333
5,870,867 A * 2/1999 Mitchell ..... E04B 2/7457 52/270
5,886,306 A * 3/1999 Patel ..... B32B 7/06 181/290
5,924,247 A * 7/1999 Van Horn ..... E04B 2/8629 52/505
5,948,706 A * 9/1999 Riedel ..... C08L 93/02 530/201
5,950,396 A * 9/1999 Fosdick, Jr. ..... B28B 7/0032 52/125.4
5,953,883 A * 9/1999 Ojala ..... E04B 1/26 52/270
6,224,706 B1 * 5/2001 Matich ..... B32B 7/08 428/137
6,235,367 B1 * 5/2001 Holmes ..... E04B 1/14 52/309.7
6,305,142 B1 * 10/2001 Brisson ..... E04C 1/40 52/505
6,387,489 B2 * 5/2002 Willemse ..... B44C 5/043 428/326
6,412,243 B1 * 7/2002 Sutelan ..... E04B 7/102 52/783.17
6,955,016 B1 * 10/2005 Churches ..... E04B 1/04 52/745.12
7,166,355 B2 * 1/2007 Jahns ..... C04B 20/1033 428/402.22
7,204,060 B2 * 4/2007 Hunt ..... E04D 13/0648 52/270
7,219,474 B2 * 5/2007 Lawson ..... E04C 2/06 52/432
7,226,033 B2 * 6/2007 Foucher ..... E04B 1/0023 52/270
8,082,710 B2 * 12/2011 Sigurdson ..... E04B 1/04 52/568
8,114,210 B2 * 2/2012 Hampson ..... C09D 201/06
8,132,388 B2 * 3/2012 Nagy ..... E04B 1/04 52/261
8,415,009 B2 * 4/2013 Peng ..... C04B 20/1029 428/312.4
8,484,918 B2 * 7/2013 Merkel ..... B29C 70/025 52/309.3
8,534,028 B2 * 9/2013 Wojtusik ..... B29C 33/10 52/270
8,590,215 B2 * 11/2013 Damichey ..... E04B 1/04 52/584.1
9,493,938 B2 * 11/2016 Schiffmann ..... E04C 2/46
9,809,979 B2 * 11/2017 Palermo ..... E04C 2/38
10,077,553 B2 * 9/2018 Neumayr ..... E04B 1/14
10,087,643 B2 * 10/2018 Lubberts ..... E04B 1/383
10,167,232 B1 * 1/2019 Wambaugh ..... E04C 2/26
10,363,648 B2 * 7/2019 Bryntesen ..... B24C 3/32
10,577,798 B1 * 3/2020 Hodgson ..... E04B 2/38
10,829,924 B2 * 11/2020 McGurn ..... E04B 1/7038
10,934,709 B2 * 3/2021 Puppi ..... E04H 4/0043
11,536,026 B2 * 12/2022 Ranganathan ..... E04C 2/243
2004/0098934 A1 * 5/2004 Lawson ..... E04C 2/06 52/270
2004/0103601 A1 * 6/2004 Bergqvist ..... E04D 3/366 52/157
2006/0096202 A1 * 5/2006 DelZotto ..... E04B 1/04 52/274
2007/0051061 A1 * 3/2007 Weinmann ..... B28B 19/003 52/302.1
2007/0062146 A1 * 3/2007 Van Dijk ..... E04C 2/22 52/580
2008/0016802 A1 * 1/2008 Rheaume ..... E04C 2/26 52/220.1
2008/0120942 A1 * 5/2008 Franklin ..... B28B 7/0032 52/425
2010/0064623 A1 * 3/2010 Sinclair ..... E04C 1/397 29/897.3
2010/0078260 A1 * 4/2010 McNeal, Jr. ..... E01F 8/0029 181/290
2010/0083590 A1 * 4/2010 Wochnik ..... E04C 2/041 52/79.1
2011/0244191 A1 * 10/2011 Asakura ..... E04C 2/06 156/62.8
2011/0258964 A1 * 10/2011 Wu ..... E04B 1/14 52/791.1
2012/0079707 A1 * 4/2012 Shen ..... E04F 13/105 29/521
2016/0153191 A1 * 6/2016 Henderson ..... E04C 2/46 52/586.1
2017/0151688 A1 * 6/2017 Eckstein ..... B32B 21/13
2018/0023290 A1 * 1/2018 Kinser, Jr. ..... E04B 1/806 62/405
2020/0141118 A1 * 5/2020 Kreizinger ..... B32B 27/40
2022/0009196 A1 * 1/2022 Klein ..... B32B 13/06

(56) References Cited

U.S. PATENT DOCUMENTS

FOREIGN PATENT DOCUMENTS

| | | | | | |
|---|---|---|---|---|---|
| CN | 110355848 | A | * | 10/2019 | ..... B27N 3/14 |
| DE | 1509588 | A1 | * | 2/1969 | |
| DE | 202009017666 | U1 | * | 5/2010 | ..... B32B 9/04 |
| DE | 202017004749 | U1 | | 11/2017 | |
| EP | 0258734 | A2 | * | 3/1988 | ..... B28B 23/0006 |
| EP | 0965702 | A1 | | 12/1999 | |
| FR | 2896811 | A1 | * | 8/2007 | ..... B32B 19/02 |
| FR | 2909695 | A1 | | 6/2008 | |
| FR | 2950910 | A1 | | 4/2011 | |
| GB | 2429419 | A | * | 2/2007 | ..... B32B 19/02 |
| KR | 100741311 | B1 | * | 8/2007 | ..... E04B 1/80 |
| KR | 100947235 | B1 | * | 3/2010 | ..... B32B 21/14 |
| SE | 458538 | B | * | 4/1989 | ..... E04C 2/292 |
| SE | 501129 | C2 | * | 11/1994 | ..... E04C 2/26 |
| WO | WO-2012144880 | A2 | * | 10/2012 | ..... E04B 1/14 |

* cited by examiner

PANELS DESIGNED FOR PRODUCING A WALL AND METHODS FOR PRODUCING SUCH PANELS

BACKGROUND OF THE INVENTION

The invention relates to panels designed for making a wall, in particular for walls of houses.

STATE OF THE ART

At the present time, different structures exist for erecting a construction such as a house or a building. In conventional manner, prefabricated hollow concrete blocks, or bricks, are used assembled with mortar as construction of the wall progresses. But these walls have to be made on site and these methods are lengthy to implement.

Prefabricated panels made from wood or metal can be manufactured but they do not present the properties of concrete.

It is also possible to use prefabricated panels made from concrete for erecting walls from one or two panels, but these panels are heavy to transport and require a large quantity of concrete. Furthermore, when a wall is made with two concrete panels, the space between the panels is filled with a Z-shaped metal armature to ensure the strength of the panels, which makes the whole assembly very bulky.

French Patent application FR2909695 can be cited disclosing a composite structure for erecting walls, panels, or slabs, comprising a support armature formed by pieces of wood and coated with a binding product composed of cement or lime mixed with wood reinforcement particles. The support armature of the panel does not however provide sufficient reinforcement for constructions of more than two storeys.

French Patent application FR2950910 can also be cited disclosing a panel for erecting a construction comprising two parallel uprights coated with a binder formed by cement and wood chips. The panel further comprises two grooves situated respectively on two opposite surfaces of the panel to house assembly parts designed to be fixed to the uprights. Such a panel is however complex to manufacture and requires the use of at least two uprights to reinforce the panel. Nor does it give the panel sufficient bending resistance.

SUMMARY OF THE INVENTION

One object of the invention consists in remedying these shortcomings and more particularly in providing means for speeding up manufacture of walls presenting an enhanced reinforcement.

Another object consists in providing means for making a panel designed to form a wall that can be prefabricated and that is able to be transported from the prefabrication site to the erection site where the walls are to be placed.

According to one feature of the invention, a panel designed for fabrication of a wall is proposed comprising a monobloc part made from concrete inside which pieces of wood are sunk, at least one through aperture being formed inside the monobloc part, the panel comprising at least one reinforcement element providing a bending resistance and housed inside said at least one through aperture, and said at least one reinforcement element being formed by an armature coated with a hardening product comprising a binder.

The reinforcement elements provided with an armature have a better bending resistance. A panel is thus provided that enables a wall to be erected more quickly and that presents an enhanced strength. Advantageously, such a panel can be easily transportable due to the reinforcement elements, and can therefore be prefabricated and then transported to the site to erect the walls of the house or building to be constructed. Furthermore, with such a reinforcement element, panels of great length can be manufactured, for example more than eight metres.

An opening to receive a casement can be formed in the monobloc part, two through apertures are formed on each side of the opening and two reinforcement elements are respectively housed inside the two through apertures and are fixed to the monobloc part.

According to another feature, a panel designed for erection of a wall is proposed, comprising at least one reinforcement element that is resistant to bending, said at least one reinforcement element being formed by an armature coated with a hardening product comprising a binder, and the panel comprises at least two monobloc parts each made from concrete inside which pieces of wood are sunk and which are separated from one another by a housing inside which said at least one reinforcement element is housed and fixed to said at least two monobloc parts.

Such a panel procures the same advantages as the panel comprising a monobloc part as defined in the foregoing.

A first monobloc part can be provided with a first shoulder and a second monobloc part be provided with a second shoulder complementary to the first shoulder so that the first and second shoulders form the housing.

The first monobloc part can be perpendicular to the second monobloc part.

An opening to receive a casement leaf can be formed in the at least one monobloc part, said at least one reinforcement element is fixed to a first surface of said at least one monobloc part and an additional reinforcement element is fixed onto a second surface of said at least one monobloc part opposite the first surface.

According to another feature, a method for manufacturing a panel comprising a monobloc part is proposed, the method comprising pouring a liquid concrete in which pieces of wood are sunk into a mould provided with at least one re-entrant to form a monobloc part, removal of said at least one re-entrant to form at least one through aperture inside the monobloc part, placing an armature in said at least one through aperture, and pouring a hardening product comprising a binder in said at least one through aperture to coat the armature and secure the latter to the monobloc part.

Such a method improves the bond between the reinforcement element and the monobloc part. The monobloc part obtained comprises contact surfaces with the reinforcement elements which present numerous microcavities, i.e. blind holes, created by the pieces of wood. In this way, when the hardening product is cast in a through aperture of the monobloc part, the product will fill the numerous microcavities to increase the contact surface between the reinforcement element and the monobloc part. The contact surface with a through aperture opening out at the level of two ends of the monobloc part is increased all the more.

According to another feature, a method for manufacturing a panel comprising at least two monobloc parts is proposed, the method comprising provision of at least two monobloc parts each made from concrete inside which pieces of wood are sunk and separated from one another by at least one housing, placing an armature in said at least one housing, and pouring a hardening product comprising a binder into said at least one housing to coat the armature and fix the latter to said at least two monobloc parts.

Such a method procures the same advantages as the method for manufacturing a panel comprising a monobloc part as defined in the foregoing.

The provision step can comprise arrangement of at least one re-entrant in a mould, pouring liquid concrete in which the pieces of wood are sunk into the mould and removal of said at least one re-entrant to form said at least one housing.

DESCRIPTION OF THE DRAWINGS

Other advantages and features will become more clearly apparent from the following description of particular embodiments and implementation modes of the invention given for non-restrictive example purposes only and represented in the appended drawings, in which.

DETAILED DESCRIPTION

Figure 3:
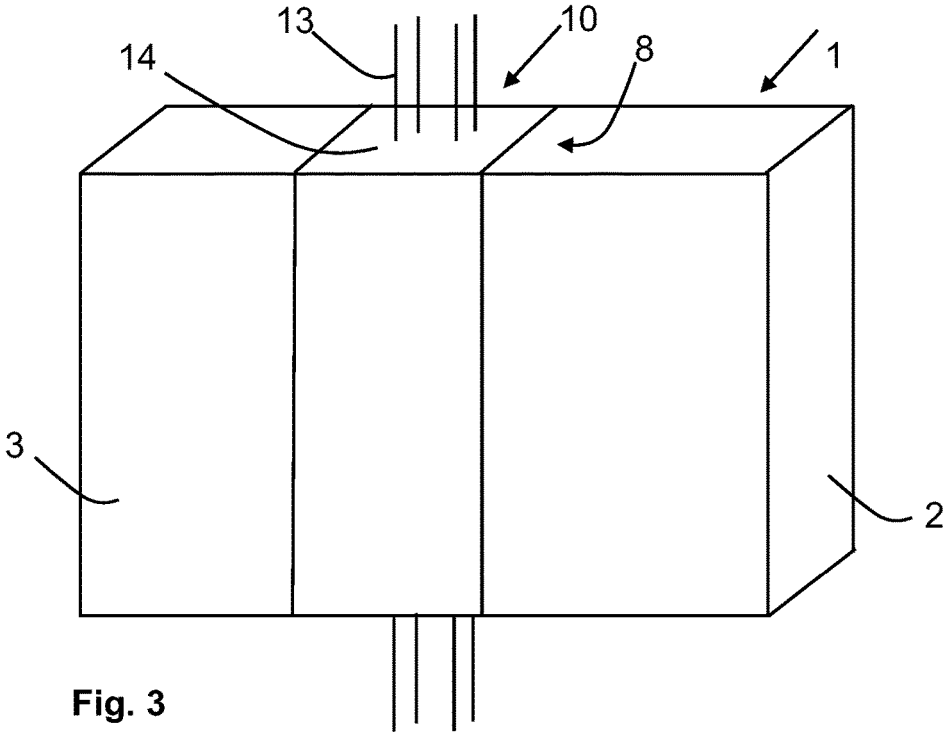
FIG. 3 schematically illustrates a perspective view of another embodiment of the panel.
Figure 4:
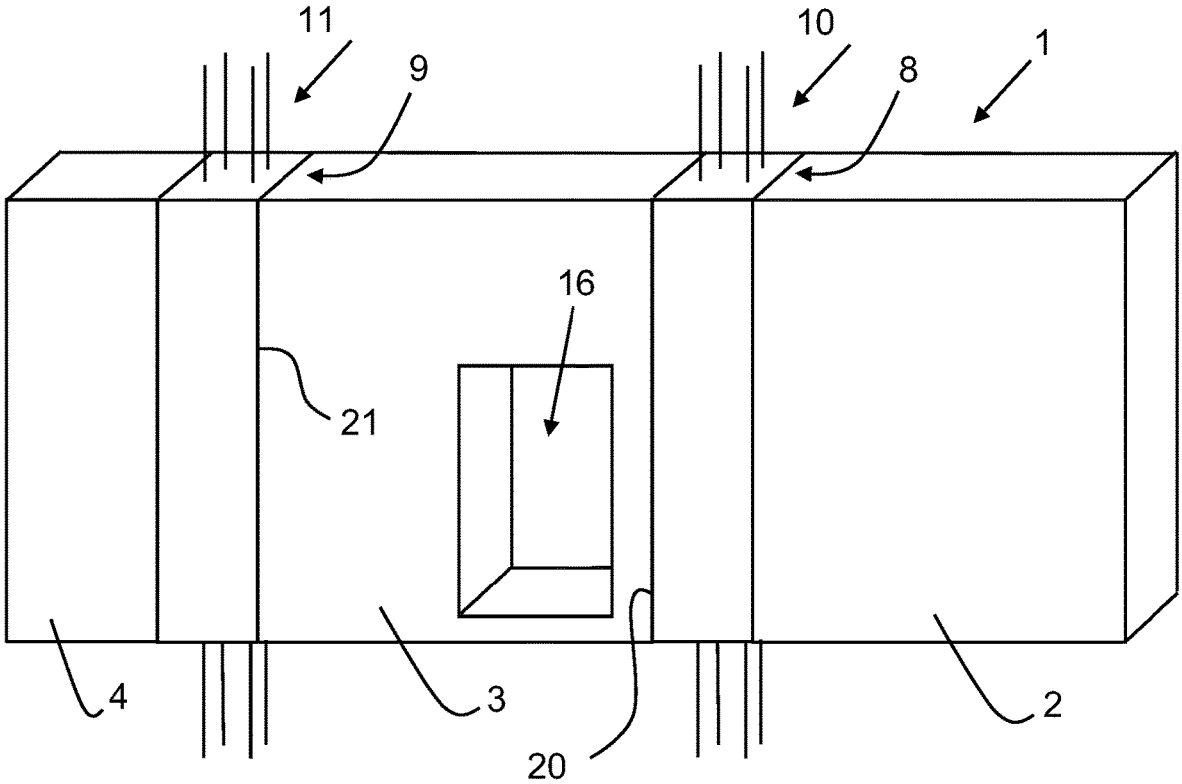
FIG. 4 schematically illustrates a perspective view of another embodiment of the panel.
Figure 5:
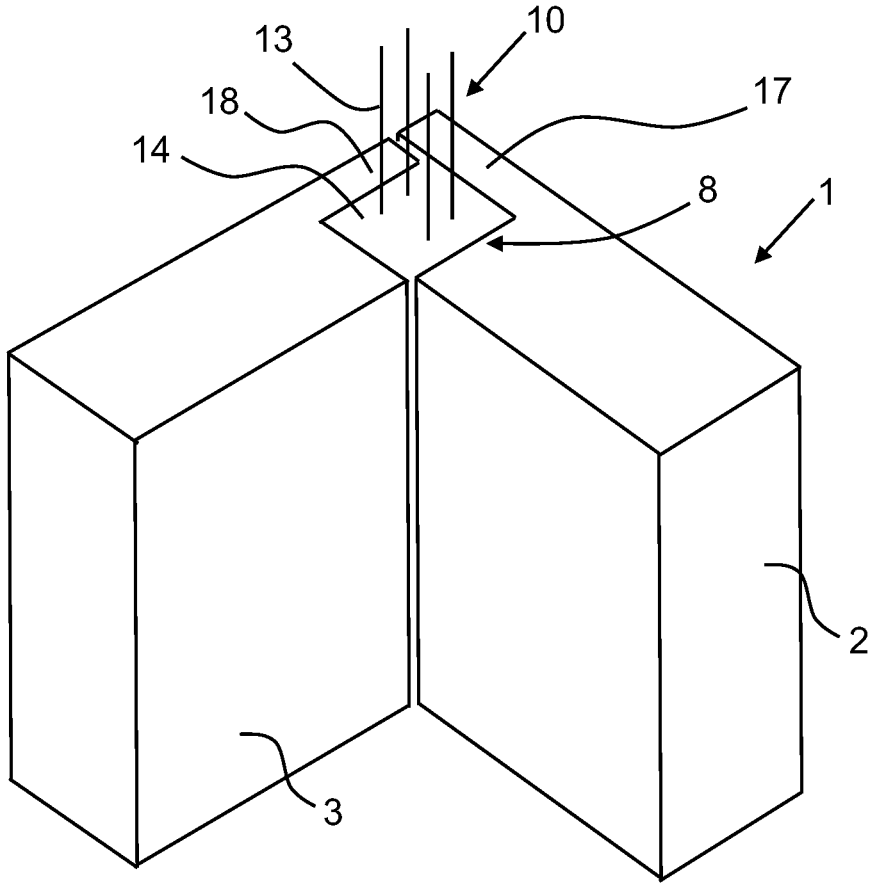
FIG. 5 schematically illustrates a perspective view of another embodiment of the panel.

In FIGS. 1 to 5, a panel 1 designed for making a wall has been represented. In particular, FIGS. 1 to 4 illustrate a panel 1 designed for making a front wall, i.e. panel 1 has a globally rectangular shape. FIG. 5 illustrates a panel 1 designed to form a corner wall, i.e. panel 1 comprise two parts perpendicular to one another, but another angle is possible. In general manner, panel 1 is particularly suitable for erecting a wall of a house with one or more storeys. Panel 1 is designed to be placed vertically with respect to the ground.

Figure 17:
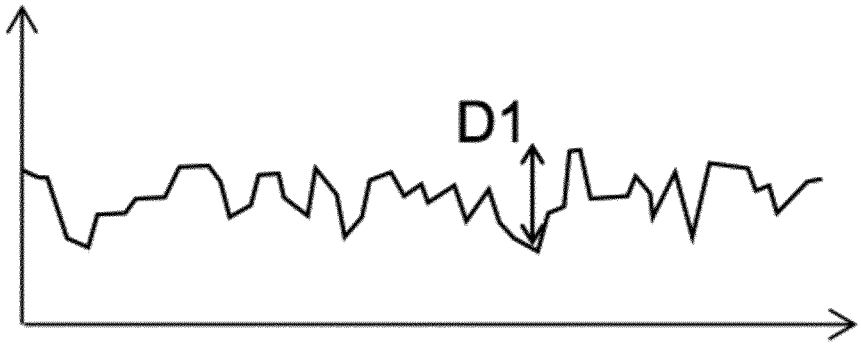
FIG. 17 schematically illustrates a cross-sectional view of a surface of the panel.

In general manner, panel 1 comprises at least one monobloc part 2 to 4. More particularly monobloc parts 2 to 4 are each made from a material comprising concrete in which pieces of wood are sunk. Such a material is also called wood-concrete. The concrete is a mixture of different elements, such as gravel, sand, a binder and water. The binder can be a cement or lime. The pieces of wood are wood chips having a length comprised between 10 and 100 mm, preferably between 20 and 60 mm. These wood chips have a thickness comprised between 1 mm and 5 mm. When wood chips having a length of between 20 and 60 mm are used, microcavities are obtained at the surface of monobloc part 2 to 4 on account of the fact that the concrete coats the wood chips. More particularly, a distribution of the cavities at the surface representing between 30% and 50% of the total surface of monobloc part 2 to 4 is obtained. Furthermore, a roughness comprised between 6 and 15 mm is obtained. The roughness corresponds to the maximum height between an apex and a trough of the surface. A sectional view of a surface of monobloc part 2 to 4 and a maximum height D1 between an apex and a trough of the surface has been represented in FIG. 17. It should be noted that cast rough concrete, i.e. construction components made from rough concrete with a formwork, have a roughness comprised between 0.3 and 3 mm and a surface distribution of the cavities of less than 30% of the total surface of the construction component. In this way, on account of the wood-concrete material using chips with a length comprised between 20 and 60 mm, more microcavities and microcavities that are deeper than a rough concrete are created. A monobloc part 2 to 4 made with such a wood-concrete material procures a greater microcavities, in number and in depth, enabling a hardening product to penetrate into these microcavities. A strong bond is thus obtained between the hardening product and the wood-concrete monobloc part 2 to 4. In addition, a weight ratio of wood chips comprised between 30% and 70% of the total weight of monobloc part 2 to 4 can be used.

The weight ratio of the wood-concrete obtained is comprised between 600 and 1000 kg/m$^3$, and by varying the composition of the material it is preferably equal to 800 kg/m$^3$. A material lighter than rough concrete is thus obtained, i.e. a concrete that does not comprise pieces of wood and that has a weight ratio of about 2300 kg/m$^3$. Furthermore, panel 1 comprises at least one housing 5 to 9 designed to receive a reinforcement element 10 to 12 that is resistant to bending.

A reinforcement element 10 to 12 is an elongate structure configured to give panel 1 a bending resistance. More particularly, each reinforcement element 10 to 12 is formed by an armature 13 coated with a hardening product 14 comprising a binder. Armature 13 also has an elongate shape. Armature 13 comprises one or more elongate elements. Each elongate element can be a rod or a bar. For example, an armature 13 comprising four rods has been represented in the figures. The elongate elements can be made from glass fibre or from carbon and are preferentially made from metal. Hardening product 14 is preferably a concrete. Such a reinforcement element enhances the bending resistance of panel 1.

Generally, a reinforcement element 10 to 12 extends along a vertical axis of panel 1. In particular, the length of a reinforcement element 10 that extends along the vertical axis is greater than its height and width. More particularly, in comparison with a wood or concrete component having the same cross-section as that of reinforcement element 10 to 12, reinforcement element 10 to 12 procures a better bending resistance.

Monobloc parts 2 to 4 made from wood-concrete enable different finishing operations to be performed, such as applying a finish coating (which is difficult to achieve on cast rough concrete), and enable fastening means of the panels to be fixed directly on site, such as for example metal plates which can be easily screw-fastened directly onto the wood-concrete. Wood-concrete does in fact enable screwing and fixing to be performed directly, without prior drilling or wall plugs, to gain time.

Several embodiments of a panel 1 have been represented in FIGS. 1 to 5.

Figure 1:
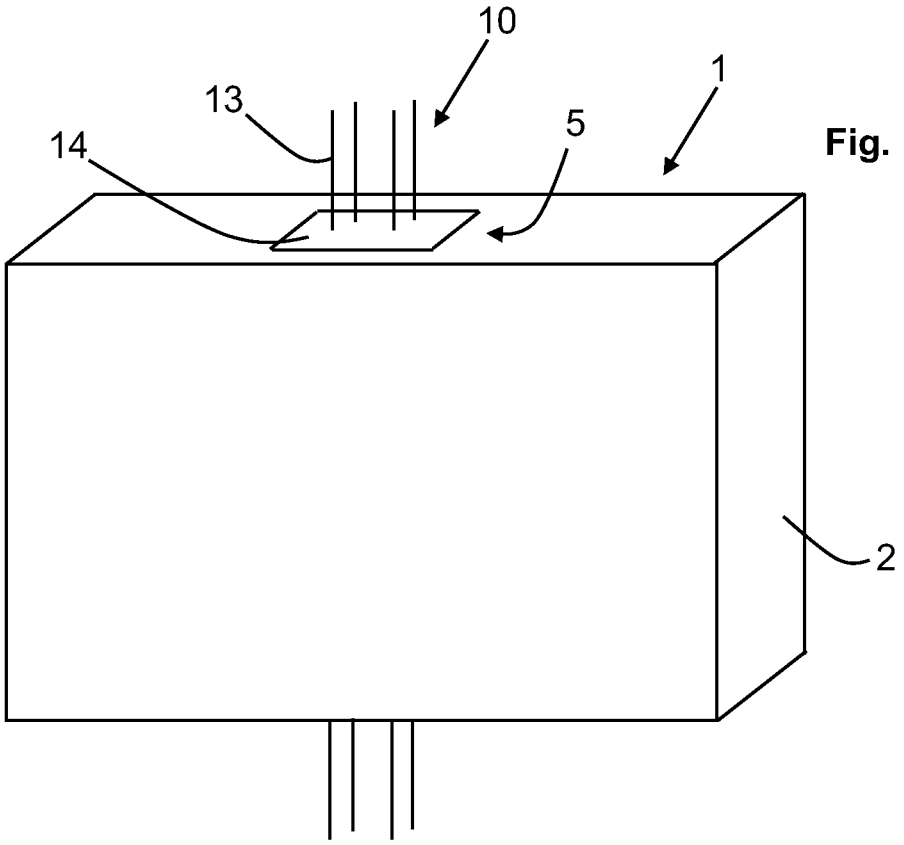
FIG. 1 schematically illustrates a perspective view of an embodiment of a panel according to the invention.
Figure 2:
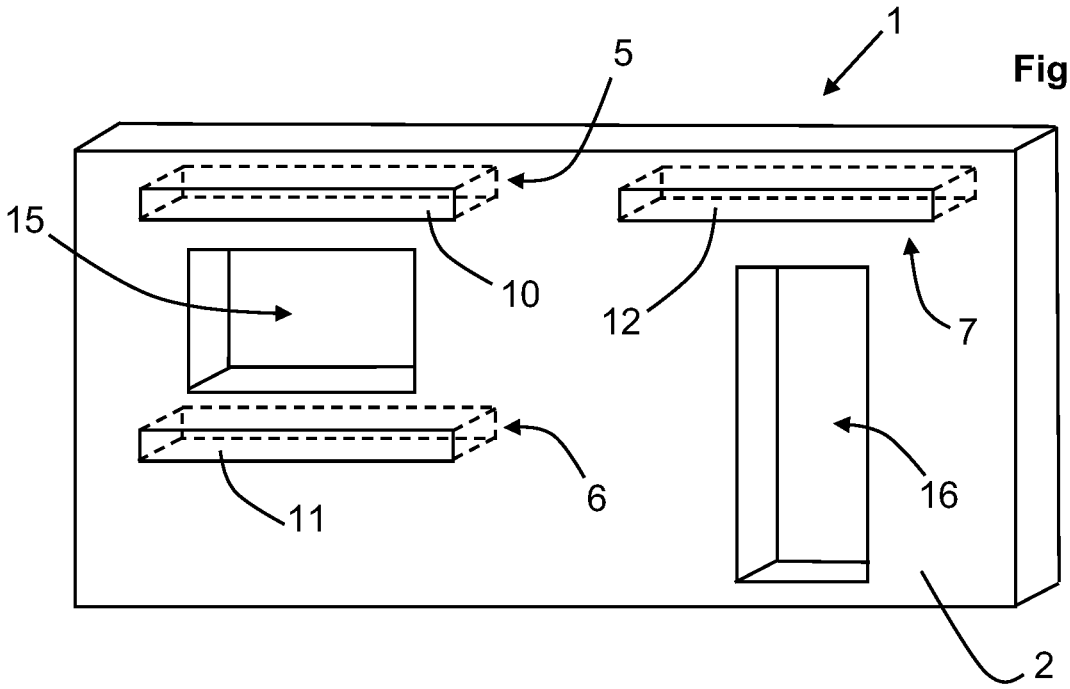
FIG. 2 schematically illustrates a perspective view of another embodiment of the panel.

In FIGS. 1 and 2, an embodiment of panel 1 has been represented in which said at least one housing 5 to 9 is a through aperture 5 to 7 formed within monobloc part 2. What is meant by through aperture is a hole the wall of which extends along the body of the part. Unlike a groove, such a through aperture opens only onto two surfaces of the part. In FIG. 1, a reinforcement element 10 is housed in through aperture 5. In FIG. 2, the panel comprises three through apertures 5 to 7 in which three reinforcement elements 10 to 12 are respectively housed. Such a panel 1 enables reinforcement elements 10 to 12 to be coated with wood-concrete on four surfaces.

In FIGS. 3 and 4, another embodiment of panel 1 has been represented in which at least two monobloc parts 2 to 4 are separated from one another by a housing 8, 9 in which a reinforcement element 10, 11 is housed and fixed to the two monobloc parts 2 to 4. In FIG. 3, panel 1 comprises a housing 8 in which a reinforcement element 10 is housed. In particular, reinforcement element 10 presents two opposite ends respectively joined to two monobloc parts 2, 3. Reinforcement element 10 thus comprises two opposite surfaces joining the two opposite ends of reinforcement element 10. These two opposite ends are visible, unlike the embodiment illustrated in FIGS. 1 and 2.

Furthermore, at least one opening 15, 16 can be formed in a monobloc part 2 to 4. Openings 15, 16 are designed to receive a casement, such as a window or a door. Prefabricated panels 1 equipped with surrounds for the casement leafs can thus be provided.

In FIG. 2, panel 1 comprises a first opening 15 shaped to receive a window, and a second opening 16 shaped to receive a door. Preferentially, two housings 5 to 9 are situated on each side of an opening 15, 16 and two reinforcement elements 10, 11 are respectively housed in two housings 5 to 9. A panel 1 meeting earthquake-resistant standards is thus provided. In FIG. 2, two reinforcement elements 10, 11 are situated on each side of first opening 15. In FIG. 4, a first reinforcement element 10 is fixed to a first surface 20 of a first monobloc part 2 and an additional reinforcement element 11 is fixed on a second surface 21 of first monobloc part 2. Second surface 21 is opposite first surface 20 of first monobloc part 2.

In FIG. 5, a panel 1 particularly suitable for erecting a corner wall has been represented. Panel 1 comprises two monobloc parts 2, 3. A first monobloc part 2 is provided with a first shoulder 17 and second monobloc part 3 is provided with a second shoulder 18 complementary to first shoulder 17 so that first and second shoulders 17, 18 form a housing 8 designed to receive a reinforcement element 10 to 12. Preferentially, first monobloc part 2 is perpendicular to second monobloc part 3.

Figure 16:
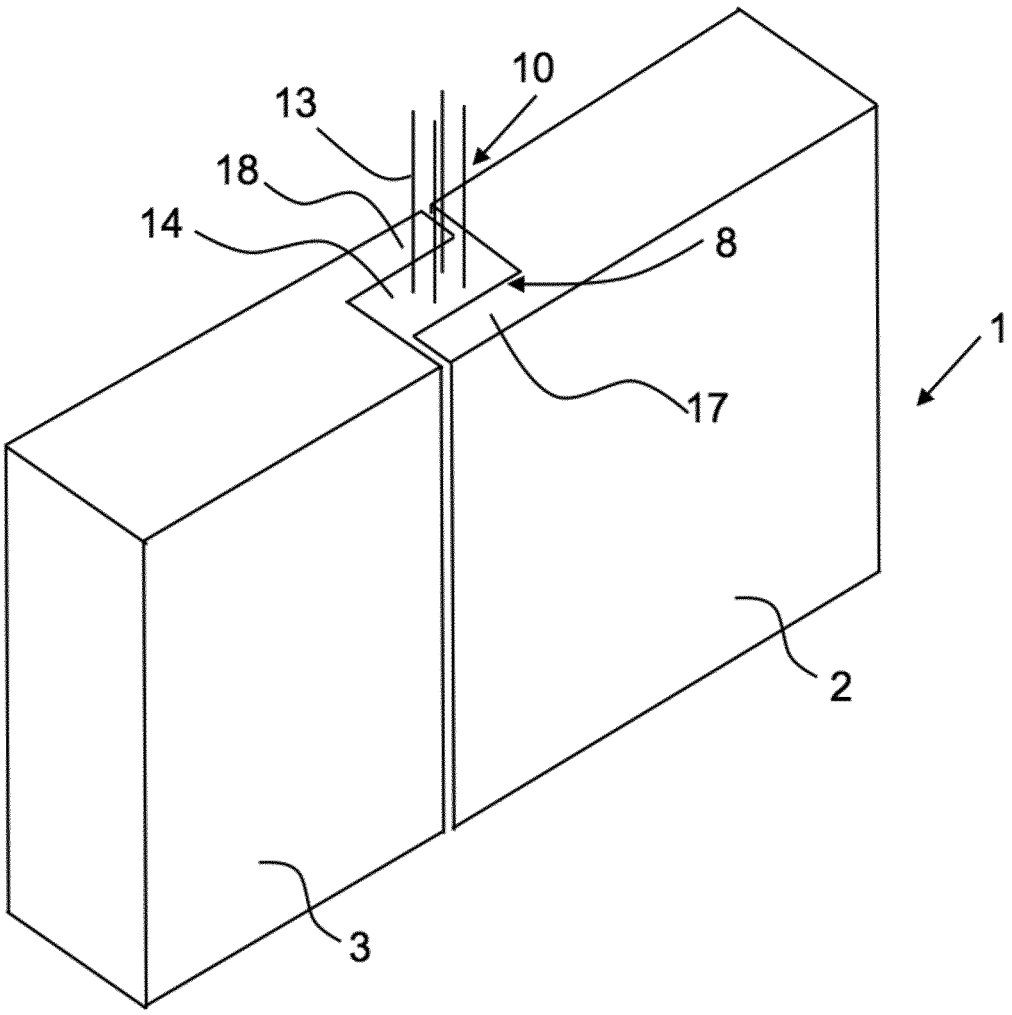
FIG. 16 schematically illustrates a perspective view of another implementation mode of the panel.

In FIG. 16, another embodiment of a panel 1 particularly suitable for erecting a front wall has been represented. Panel 1 comprises two monobloc parts 2, 3. A first monobloc part 2 is provided with a first shoulder 17 and second monobloc part 3 is provided with a second shoulder 18 complementary to first shoulder 17 so that first and second shoulders 17, 18 form a housing 8 designed to receive a reinforcement element 10 to 12. In this embodiment, first and second monobloc parts 2, 3 extend in the same plane.

Such panels 1 reinforced by reinforcement elements 10 to 12 are resilient and can be transported easily. They can therefore be prefabricated in a plant without necessarily being manufactured on the building site of the house or building. Manufacture of the panels in plant is better mastered. Advantageously, armatures 13 have parts salient from hardening product 14, i.e. free parts, to provide hoisting parts of panel 1. Advantageously these salient parts can be used on the building site to join the panels to one another. A free part of armature 13 can be joined to another free part of another panel or of a floor.

In yet another embodiment, the re-entrant arranged in the mould enables a groove to be defined in the monobloc part. After the hardening product has been poured, the latter forms a part having one surface that is visible and accessible. Preferentially, the visible surface is in the same plane as the surface of the monobloc part.

To manufacture the panels defined in the foregoing, at least one monobloc part 2 to 4 is manufactured from wood-concrete, an armature 13 is placed in a housing 5 to 9, and hardening product 14 is then poured into housing 5 to 9, around armature 13 and in contact with at least one surface of monobloc part 2 to 4. Pouring hardening product 14 into the provided housings 5 to 9 enhances the strength of the bond between hardening product 14 and the wood-concrete in comparison with a concrete-concrete bond. Such a method increases the mechanical strength of reinforcement element 10 to 12 with monobloc part 2 to 4. The bond between reinforcement element 10 to 12 and monobloc part 2 to 4 is moreover strengthened on account of the microcavities created at the surface of monobloc part 2 to 4 and of pouring of liquid hardening product 14 which penetrates into these microcavities. After hardening product 14 has hardened, a strong bond is obtained with a high shear strength.

Figure 6:
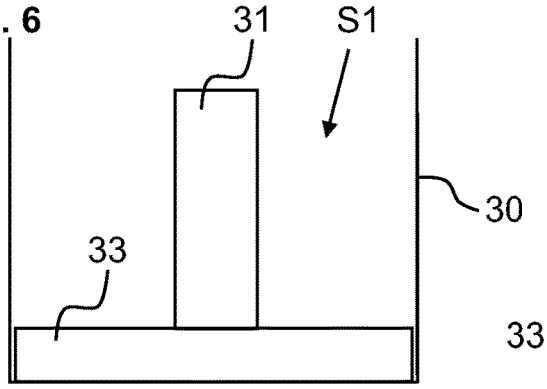
FIG. 6 schematically illustrates a first step of an implementation mode of a method for manufacturing a panel according to the invention.
Figure 7:
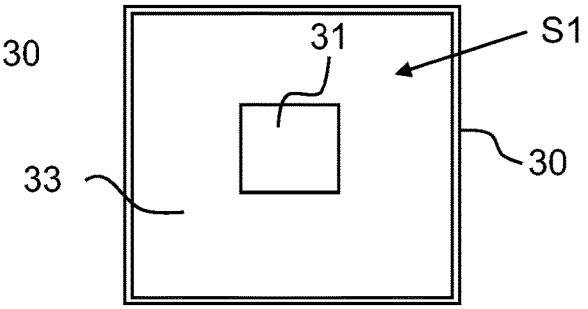
FIG. 7 schematically illustrates a top view of the first step of the method.
Figure 8:
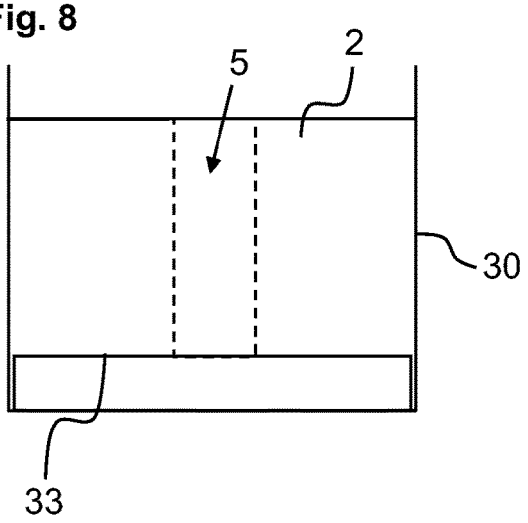
FIG. 8 schematically illustrates a second step of the method for manufacturing the panel.
Figure 9:
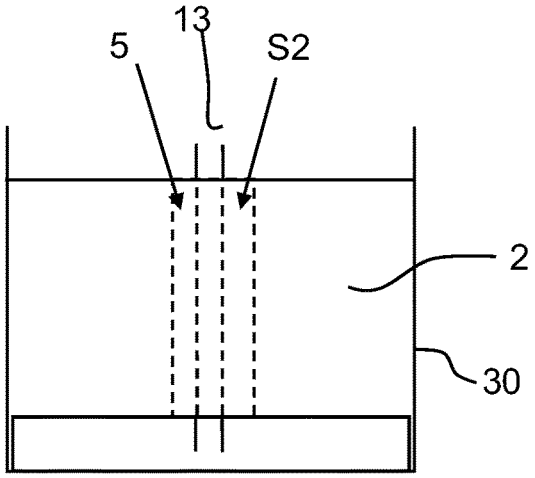
FIG. 9 schematically illustrates a third step of the method for manufacturing the panel.
Figure 10:
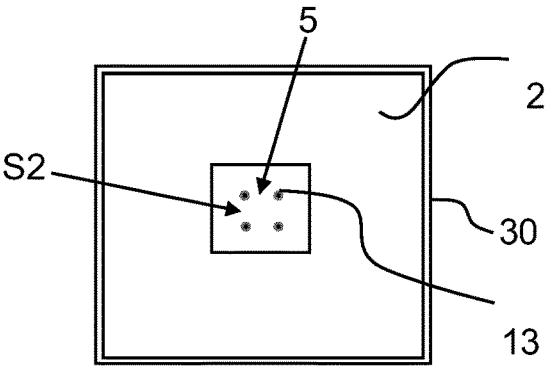
FIG. 10 schematically illustrates a top view of the third step of the method.

In FIGS. 6 to 10, the steps of a first implementation mode of a method for manufacturing a panel 1 comprising a monobloc part 2 as illustrated in FIGS. 1 and 2 have been represented. The method comprises a first step S1 in which the liquid concrete in which the pieces of wood are sunk is poured into a mould 30 provided with at least one re-entrant 31, 32, as illustrated in FIGS. 6 and 7. For example, a plinth 33 on which re-entrants 31, 32 are positioned can be placed at the bottom of mould 30. After the liquid concrete has hardened, monobloc part 2 is obtained, as illustrated in FIG. 8. Then, in a second step illustrated in FIG. 8, each re-entrant 31, 32 is removed in order to form at least one through aperture 5 to 7 in monobloc part 2. Then, in a third step illustrated in FIGS. 9 and 10, an armature 13 is placed inside each formed through aperture 5 to 7, as illustrated in FIGS. 9 and 10. For example, armature 13 can be made to pass through plinth 33 in order to obtain an armature 13 having a part salient from hardening product 14. The salient parts of armature 13 facilitate joining of two adjacent panels 1. For example another liquid concrete is used to bind the salient parts of armatures 13 to one another. Hardening product 14 comprising a binder is then poured, in step S2, into each through aperture 5 to 7 to coat armature 13 and secure the latter to monobloc part 2, as illustrated in FIGS. 9 and 10.

Figure 11:
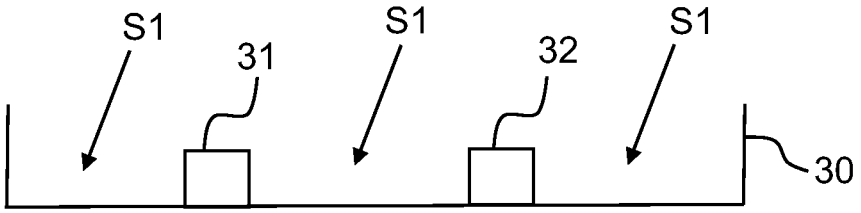
FIG. 11 schematically illustrates an initial step of another implementation mode of a method for manufacturing a panel according to the invention.
Figure 12:
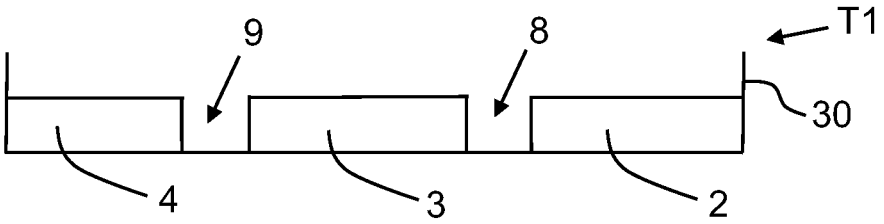
FIG. 12 schematically illustrates a first step of the method for manufacturing the panel.

In FIGS. 11 to 15, the steps of a second implementation mode of a method for manufacturing a panel 1 have been represented. According to this second implementation mode, a panel 1 comprising at least two monobloc parts 2 to 4 is manufactured, as illustrated in FIGS. 3 and 4. The method comprises a first step T1 of providing at least two monobloc parts 2 to 4 each made from concrete in which pieces of wood are sunk and separated from one another by at least one housing 8, 9, as illustrated in FIG. 12. As a variant, provision step T1 comprises an initial step, illustrated in FIG. 11, in which at least one re-entrant 31, 32 is arranged in a mould 30, as illustrated in FIG. 11, followed by pouring S1 of the liquid concrete, in which the pieces of wood are sunk, into mould 30. Removal of re-entrants 31, 32 is then performed to form housings 8, 9.

Figure 13:
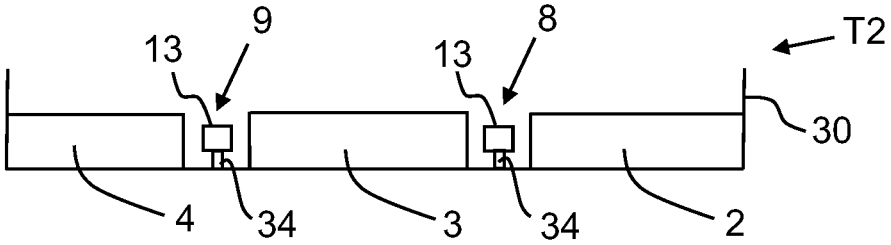
FIG. 13 schematically illustrates a second step of the method for manufacturing the panel.
Figure 14:
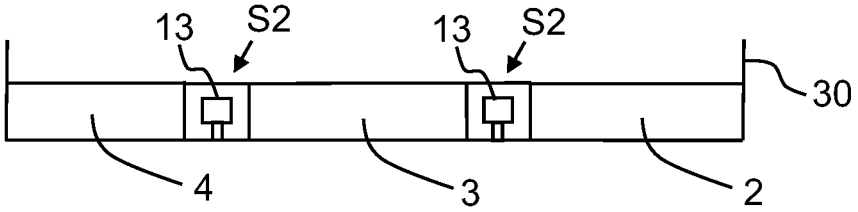
FIG. 14 schematically illustrates a third step of the method for manufacturing the panel.
Figure 15:
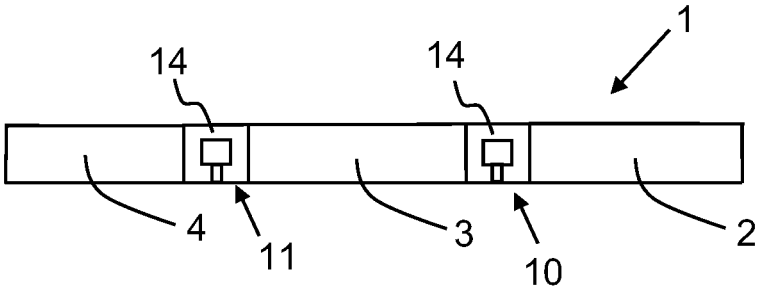
FIG. 15 schematically illustrates a fourth step of the method for manufacturing the panel.

After provision step T1, an armature 13 is placed inside each housing 8, 9 in a second step T2 illustrated in FIG. 13. Preferentially, armatures 13 rest on supports 34 to center armatures 13 inside housings 8, 9. Then, in a third step illustrated in FIG. 14, a hardening product comprising a binder is poured, step S2, into each housing 8, 9 to coat each armature 13 and to fix the latter to two adjacent monobloc parts 2 to 4. What is meant by two adjacent monobloc parts 2 to 4 is two monobloc parts separated by a housing 8, 9. Then, in a fourth step illustrated in FIG. 15, mould 30 is removed to obtain panel 1. Supports 34 can be removed or left inside housings 8, 9.

Panel 1, illustrated in FIG. 5, can be prefabricated in plant or manufactured on site. Advantageously, monobloc parts 2, 3 are secured to one another by metal plates screwed into the wood-concrete before hardening product 14 is poured in S2. The metal plates serve the purpose of limiting the forces generated by hardening product 14 on monobloc parts 2 to 4.

Monobloc part 2 to 4 obtained comprises contact surfaces with the reinforcement elements that present numerous microcavities, i.e. blind holes, created by the pieces of wood. The concrete in fact coats the pieces of wood, which creates the microcavities at the surface of monobloc part 2 to 4. In this way, when hardening product 14 is cast in a housing 5 to 9 provided in monobloc part 2 to 4, product 14 will fill the numerous microcavities to increase the binding surface between reinforcement element 10 to 12 and monobloc part 2 to 4. The binding surface is increased all the more with a through aperture opening out at the level of two ends of monobloc part 2 to 4. A strong bond is thus obtained between hardening product 14 and the wood-concrete, which gives reinforcement element 10 to 12 a strong adhesion to monobloc part 2 to 4.

A panel is thus provided that enables a wall meeting earthquake-resistance standards to be erected more quickly, as it incorporates reinforcement elements having an enhanced bending resistance. Furthermore, such a panel is simple to achieve. Advantageously, the panel is strong and lighter than a panel made from rough concrete. Such a panel can be prefabricated and then transported to site to form the walls of the house or building to be built.

In a particular embodiment, the concrete in which pieces of wood are sunk has a chemical composition that is different from the chemical composition of the hardening product comprising a binder. This difference of chemical composition is advantageously chosen to procure a difference in the mechanical performances and in particular the Young's modulus. In a particular embodiment, the Young's modulus of the hardening product comprising a binder is higher than that of the concrete in which pieces of wood are sunk and preferentially at least 10% higher. In other words, reinforcement element 10 to 12 has different mechanical properties from the part formed from wood-concrete regardless of whether one or more armature parts 13 are used.

The area of hardening product comprising a binder extends from one end of the panel to the other with a lateral dimension, i.e. perpendicular to the longitudinal axis of the reinforcement element, of at least 1 cm and preferably at least 5 cm.

The hardening product comprising a binder is preferentially a product that comprises a volume content in pieces of wood that is lower than the volume content in pieces of wood of the concrete in which pieces of wood are sunk. It is advantageous for the volume content in pieces of wood in the hardening product to be less than or equal to 90% of the content in pieces of wood in the wood-concrete, preferentially less than or equal to 80% and even more preferentially less than or equal to 50%. The volume of pieces of wood is reduced which improves the mechanical strength between the armature and the hardening product in comparison with the mechanical strength between the armature and the wood-concrete in an equivalent configuration.

When the hardening product is added to the monobloc part, it enters the microcavities thereby procuring the mechanical strength between the monobloc part and the part formed by the hardening material that hardened. It is advantageous for the hardening material, when it hardens, to be less porous than the material forming the monobloc part thereby facilitating formation of an interface procuring a high mechanical strength.

In preferential manner, the hardening product comprising a binder is devoid of pieces of wood and more preferentially a concrete devoid of pieces of wood. Armature 13 is sunk in hardening product devoid of pieces of wood to ensure a good mechanical cohesion and the hardening product devoid of pieces of wood anchors onto the side walls of the wood-concrete part where a re-entrant was made.

In a particular embodiment, the volume content of pieces of wood is decreasing from monobloc part 2 to the area immediately around the reinforcement elements. In preferential manner, the decreasing volume content of pieces of wood is configured so that the reinforcement element is only in contact with hardening product, preferably concrete, i.e. the reinforcement element has no contact with a wood part.

When several armatures 13 are installed in the monobloc part, it is preferable for the material arranged between armatures 13 to be devoid of pieces of wood and preferentially a concrete devoid of pieces of wood.

In another particular embodiment that can be combined with the previous embodiments, the hardening product comprising a binder is a product that contains pieces of wood the average size of which is smaller than the average size of the pieces of wood contained in the wood-concrete. By using smaller pieces of wood, the cavities formed in the wood-concrete are smaller which improves the mechanical performances of the hardening product. In advantageous manner, the average size of the pieces of wood in the hardening product is less than 70% of the average size of the pieces of wood contained in the wood-concrete, more preferentially at least less than 50% of the average size of the pieces of wood contained in the wood-concrete.

In a preferred embodiment, reinforcement element 10 to 12 is a rod or a bar made from metal, for example from steel.

In an advantageous embodiment, one or more screws are screwed into the walls of the monobloc part after the re-entrant has been removed and before the hardening product is poured. The hardening product is poured and the screws are sunk in the hardening product which improves the mechanical strength between the wood-concrete part and reinforcement element 12. In preferential manner, the screws are screwed directly into the wood-concrete, i.e. without making a hole beforehand and without adding a wall plug.

The invention claimed is:

1. A panel designed for fabrication of a wall, comprising:

at least one monobloc part made from wood chips covered by concrete, the wood chips having a length between 20 mm and 60 mm and a thickness between 1 mm and 5 mm, the at least one monobloc part having a weight ratio of wood chips between 30% and 70% of a total weight of the at least one monobloc part, the at least one monobloc part having microcavities at a surface and the microcavities representing between 30% and 50% of the surface, the at least one monobloc part defining at least one through aperture designed to form a housing, the at least one monobloc part forming a ring around the housing;

at least one reinforcement element housed in the housing, the at least one reinforcement element comprising an armature comprising one or more rods or bars, the armature being coated with a hardening product comprising an additional concrete, the hardening product being present in the microcavities.

2. The panel according to claim 1, wherein the hardening product is chemically different from the concrete of the at least one monobloc part, the hardening product having a Young's modulus at least 10% higher than the Young's modulus of the concrete of the at least one monobloc part.

3. The panel according to claim 2, wherein the hardening product comprises a volume content of wood chips that is at least 10% lower than a volume content of wood chips of the at least one monobloc part.

4. The panel according to claim 3, wherein the hardening product is devoid of wood chips.

5. The panel according to claim 1, wherein the hardening product comprises wood chips having an average size at least 30% smaller than an average size of the wood chips of the at least one monobloc part.

6. The panel according to claim 1, wherein several reinforcement elements are housed in said at least one housing and wherein the hardening product comprising a binder arranged between the reinforcement elements, the binder being a concrete devoid of wood chips.

7. The panel according to claim 1 comprising first and second monobloc parts of the at least one monobloc part each made from concrete and wood chips, the first and second monobloc parts being separated from one another by the housing, said at least one reinforcement element being fixed to said first and second monobloc parts.

8. The panel according to claim 7, wherein the first monobloc part is provided with a first shoulder and the second monobloc part is provided with a second shoulder complementary to the first shoulder so that the first and second shoulders form the housing.

9. The panel according to claim 8, wherein the first monobloc part is perpendicular to the second monobloc part.

10. The panel according to claim 7, wherein the housing is formed in at least one monobloc part, said at least one reinforcement element is fixed to a first surface of said at least one monobloc part and an additional reinforcement element is fixed on a second surface of said at least one monobloc part opposite the first surface.

11. A method for manufacturing a panel according to claim 7, wherein it comprises provision of at least two monobloc parts each made from concrete in which pieces of wood are sunk and separated from one another by at least one housing, placing an armature in said at least one housing, and pouring of a hardening product comprising a binder into said at least one housing to coat the armature and fix the latter to said at least two monobloc parts.

* * * * *